US007448112B2

(12) United States Patent
Li

(10) Patent No.: US 7,448,112 B2
(45) Date of Patent: Nov. 11, 2008

(54) CHALK-DUST COLLECTING APPARATUS FOR BLACKBOARD ERASER

(75) Inventor: Po-Cheng Li, Caotun Township, Nantou County (TW)

(73) Assignee: Global Metal Supplier Corp., Nantou County (TW)

( * ) Notice: Subject to any disclaimer, the term of this patent is extended or adjusted under 35 U.S.C. 154(b) by 173 days.

(21) Appl. No.: 11/648,518

(22) Filed: Jan. 2, 2007

(65) Prior Publication Data

US 2008/0155778 A1 Jul. 3, 2008

(51) Int. Cl.
*A47L 7/00* (2006.01)
*A47L 25/00* (2006.01)

(52) U.S. Cl. ..... 15/310; 15/347; 15/401

(58) Field of Classification Search ..... 15/3, 15/310, 347, 401; *A47L 7/00, 9/16, 25/00; B43L 21/02*
See application file for complete search history.

(56) References Cited

U.S. PATENT DOCUMENTS 1,757,545 A * 5/1930 Palmer ..... 15/311
1,830,129 A * 11/1931 O'Reilly et al. ..... 15/310
1,935,250 A * 11/1933 Palmer ..... 15/310
2,306,911 A * 12/1942 Schaefer ..... 15/311
2,666,942 A * 1/1954 Coleman ..... 15/305
2,779,046 A * 1/1957 Queirolo ..... 15/310
3,395,413 A * 8/1968 Dalton ..... 15/4

FOREIGN PATENT DOCUMENTS

JP 200310075 * 1/2003

* cited by examiner

*Primary Examiner*—David A Redding
(74) *Attorney, Agent, or Firm*—Troxell Law Office PLLC

(57) ABSTRACT

A chalk-dust collecting apparatus for blackboard erasers has a housing that contains a dust-collecting bag, a filter and a vacuum suction device. The housing is affixed with an upper lid on the top thereof. The dust-collecting bag is with its top end attached by a lid. The lid is received by the outer shoulder portion of the intermediate cover and comprises a plurality of lower air inlet slits. Further, the upper lid has a plurality of upper air inlet slits arranged correspondingly to the lower air inlet slits in the manner that each said upper air inlet slit is intercommunicated with a respective said lower air inlet slit. Thereby, chalk dust at the upper air inlet slits can be directly sucked into the bag through the lower air inlet slits and prevented from diffusing between the dust-collecting bag and upper lid. Thereby cleanness of the apparatus can be achieved.

20 Claims, 12 Drawing Sheets

CHALK-DUST COLLECTING APPARATUS FOR BLACKBOARD ERASER

BACKGROUND OF THE INVENTION

1. Technical Field

The present invention relates to a dust collecting apparatus, and more particularly, to a chalk-dust collecting apparatus for blackboard erasers with an improved dust-collecting bag.

2. Description of Related Art

A conventional chalk-dust collecting apparatus, as shown in FIG. 12, typically comprises a suction motor C presenting suction force to draw chalk dust into a dust-collecting bag G from an upper air inlet I located at an upper lid J of the housing A. As the dust-collecting bag G is typically designed with a wide opening, chalk dust drawn thereto and retained therein can easily diffuse or escape therefrom and disadvantageously results in contamination and pollution of the surrounding area.

Besides, as there is no any filterable component particularly provided for the suction motor C at the front end air entrance F, escaped or diffused dust coming fro the dust-collecting bag G can be drawn directly into the suction motor C and cause significant mechanical damage. Even worse, in the occasion the dust-collecting bag G is missed during assembly, and the apparatus is nevertheless operated, mass dust comes along with air flow can totally destroy the suction motor C.

SUMMARY OF THE INVENTION

The present invention has been accomplished under these circumstances in view and provides a chalk-dust collecting apparatus equipped with an air guide structure to overcome dust diffusion and a filter to ensure dust-proof effect of the suction motor.

To achieve these and other objectives of the present invention, the disclosed chalk-dust collecting apparatus for blackboard erasers comprises a housing, a vacuum suction device installed in the housing, a dust-collecting bag settled in the housing and a upper lid pivotally combined with the housing for covering the top of the housing, wherein:

the housing comprises an air inlet opening at the top thereof;

the dust-collecting bag has a bag accommodated in the housing and a lid for being combined with the periphery of the bag wherein the lid has a plurality of the lower air inlet slits and is inlayed at the air inlet opening; and the upper lid has a plurality of upper air inlet slits provided in the manner that each said lower air inlet slit is airtightly intercommunicated with a respective said upper air inlet slit.

Further, the disclosed chalk-dust collecting apparatus for blackboard erasers comprises a sunk outer shoulder portion is formed along the top periphery of the air inlet opening for receiving an annular fixing ring provided at the top periphery of the bag, a sunk inner shoulder portion is formed along the top inner periphery of the fixing ring for receiving the periphery of a lid plate included by the lid, whereby the lid, the dust-collecting bag and the housing can be airtightly combined, a top-raised prominent portion is formed at the middle of the lid plate and equipped with said lower air inlet slits, and a sealing flange is extended downward from the bottom periphery of each said upper air inlet slit for tightly pressing the periphery of a respective said lower air inlet slit.

Moreover, the vacuum suction device of the disclosed apparatus comprises a suction motor having a sealing ring sleeved onto the front end thereof where the dust-collecting bag adjacent to. A filter is provided in the housing between the dust-collecting bag and the vacuum suction device and has an air guide which is formed in an annular shaped and accommodates a filter net fastened therein. The rear end of the air guide is combined with the front end of the sealing ring and the front end of the air guide is facing the dust-collecting bag.

Preferably, at least one said upper air inlet is equipped with a scrapper.

A filter niche is formed at the front side of the air guide for receiving a partition with a plurality of through holes so that the filter net can be fastened to the partition and inlaid into the filter niche. The rear end of the filter niche is formed as a cone-shaped connecting portion to be combined with said sealing ring.

To operate the disclosed subject matter of the present invention, the vacuum suction device is firstly started and a suction force can be therefore presented at the upper air inlet slits of the housing and since each said upper air inlet slit is airtightly intercommunicated with a respective said lower air inlet, the dust can be drawn into the bag directly and retained therein.

Due to airtight intercommunication between the upper air inlet slits of the upper lid and the lower air inlet slits of the dust-collecting bag, the chalk-dust collecting apparatus of the present invention helps preventing sucked dust from diffusing between the lid and the upper lid so that the contamination and pollution as previously discussed can be completely eliminated. Also, the lid helps to keep the dust in the bag against escaping. As a result, the disclosed chalk-dust collecting apparatus contributes to a cleaner operational environment.

The present invention also provides following features:

1. As the combination of the flexible elastic loop and the pressing loop, airtight around the lid can be achieved so that chalk dust is ensured against leaking out from the lid.

2. When the dust-collecting bag is reassembled to the housing through the air inlet opening, due to the mistake-proof members are provided correspondingly to the grasping recesses, the upper lid can not be normally combined with the intermediate cover unless the dust-collecting bag is properly assembled for proper combination of the upper and lower air inlet slits. Thereby, a user can easily reassemble the dust-collecting bag without mistake and therefore the weakened suction effect as well as contamination of the housing due to forget to assemble of the dust-collecting bag can be prevented.

DETAILED DESCRIPTION OF THE PREFERRED EMBODIMENT

Figure 1:
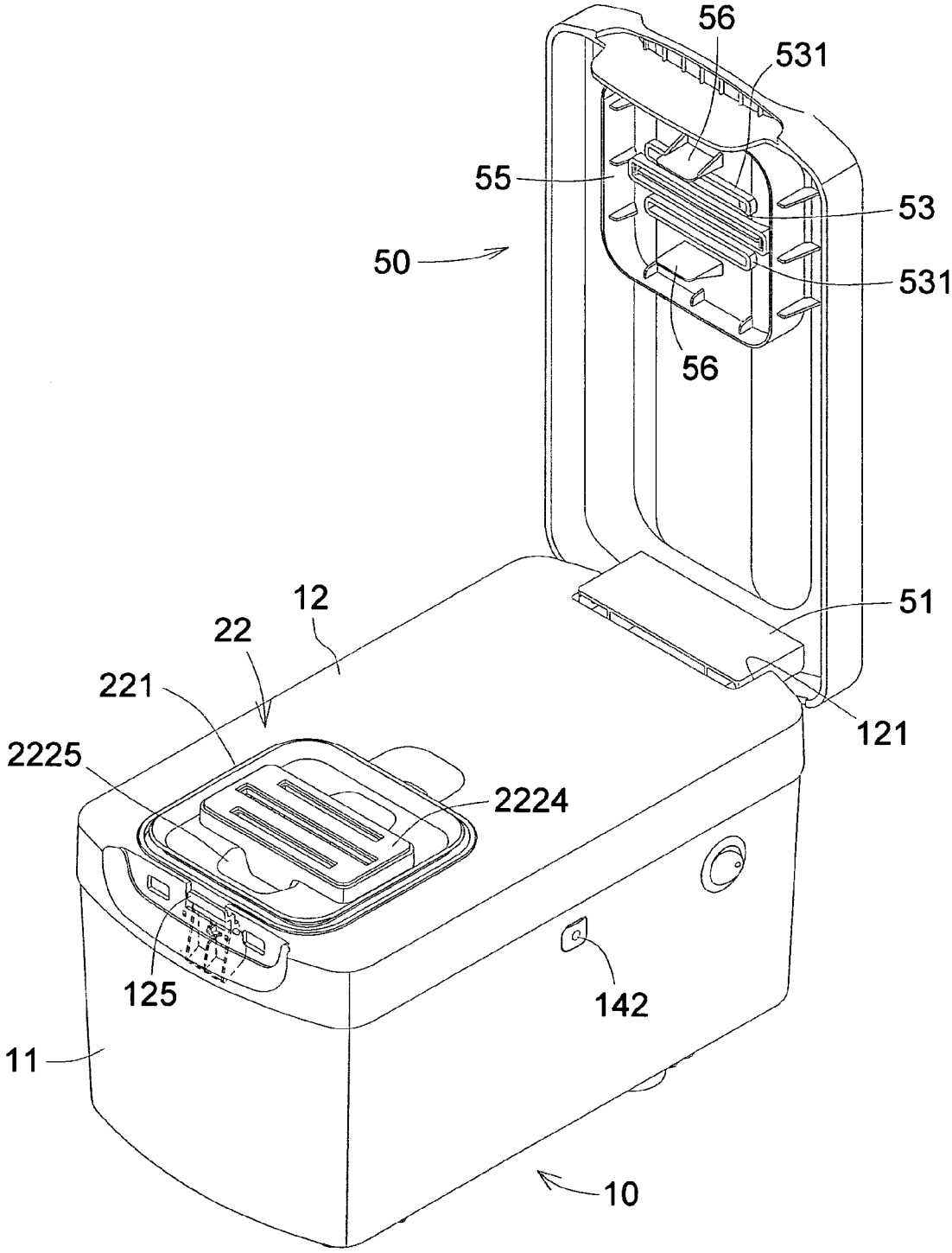
FIG. 1 is a perspective view of the discussed preferred embodiment of the present invention showing the upper lid lifted.

The present invention is herein disclosing a chalk-dust collecting apparatus for blackboard erasers and one embodiment thereof is now illustrated through FIGS. 1 to 9. According to the present embodiment, the disclosed chalk-dust collecting apparatus comprises a housing 10, a dust-collecting bag 20 deposited in the housing 10, a vacuum suction device 30 deposited in the housing 10, a filter 40 provided in the housing 10 and settled between the dust-collecting bag 20 and vacuum suction device 30, and a upper lid 50 pivotally combined with the housing 10 for covering the top of the housing 10, wherein the housing 10 has a rectangular body established by a front end, a rear end, a left side and a right side, wherein the front and rear ends are corresponding to the short sides thereof, and is composed of a bottom shell 11 and an intermediate cover 12 which are combined mutually wherein the bottom shell 11 is upward-opened and includes a left partition assembly 14 as well as a right partition assembly 13 respectively arranged at the middle portion of the lift or right side and extended inward into the bottom shell 11 whereby a dust-collecting bag seat 15, a filter seat 16 and a vacuum suction device seat 17 which are intercommunicated can be defined inside the bottom shell 11 wherein the filter seat 16 is defined between the lift and right partition assemblies 14, 13 and a vertical partition 18 with a round hole 181 at the center thereof is provided behind the filter seat 16.

Figure 7:
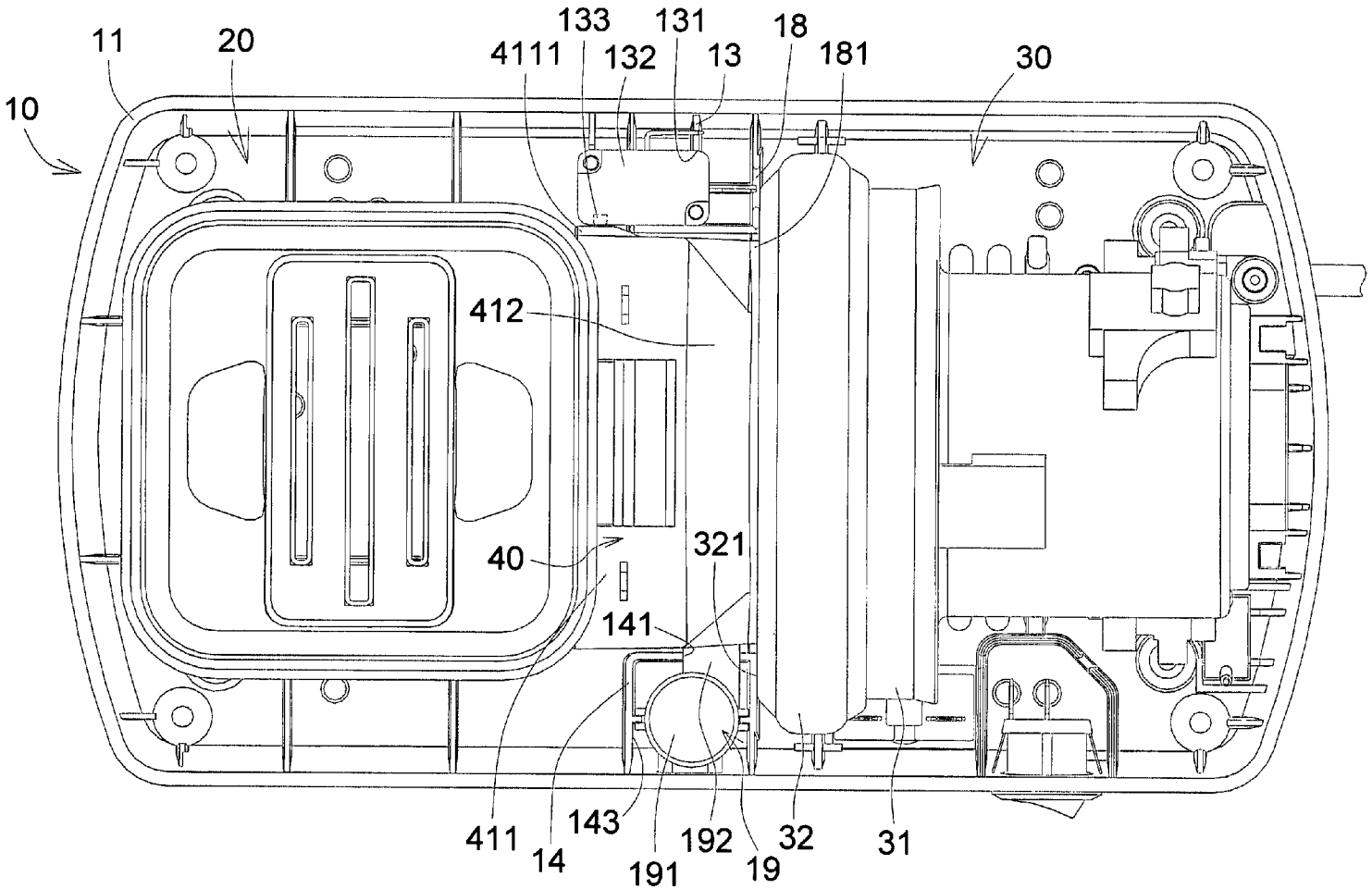
FIG. 7 is a top view showing the discussed preferred embodiment without the presence of the intermediate cover.

As shown in FIG. 7, the right partition assembly 13 includes a plurality of parallel partitions and a recess 131 located at the top and correspondingly to the filter seat 16. Inside the recess 131, a micro switch 132 is settled and a button 133 of the micro switch 132 is extended toward the filter seat 16 in the manner that the button 133 can be normally pressed by filter assemblies assembled in the filter seat 16 and the disclosed subject matter can be operated.

On the other hand, the left partition assembly 14 is formed as a square pillar by a plurality of interconnected partitions and has a vertical accommodating space 143 enclosed by the partitions. Further, a vertically extended gap 141 leading to the accommodating space 143 is provided at the surface thereof facing the filter seat 16. Thereby, a the accommodating space 143 can receive a filter monitor 19 which has a body 191 substantially in a vertical column shape, and a connecting pipe 192 provided at the bottom of the body 191 and extended right to the filter seat 16 through the gap 141.

Figure 9:
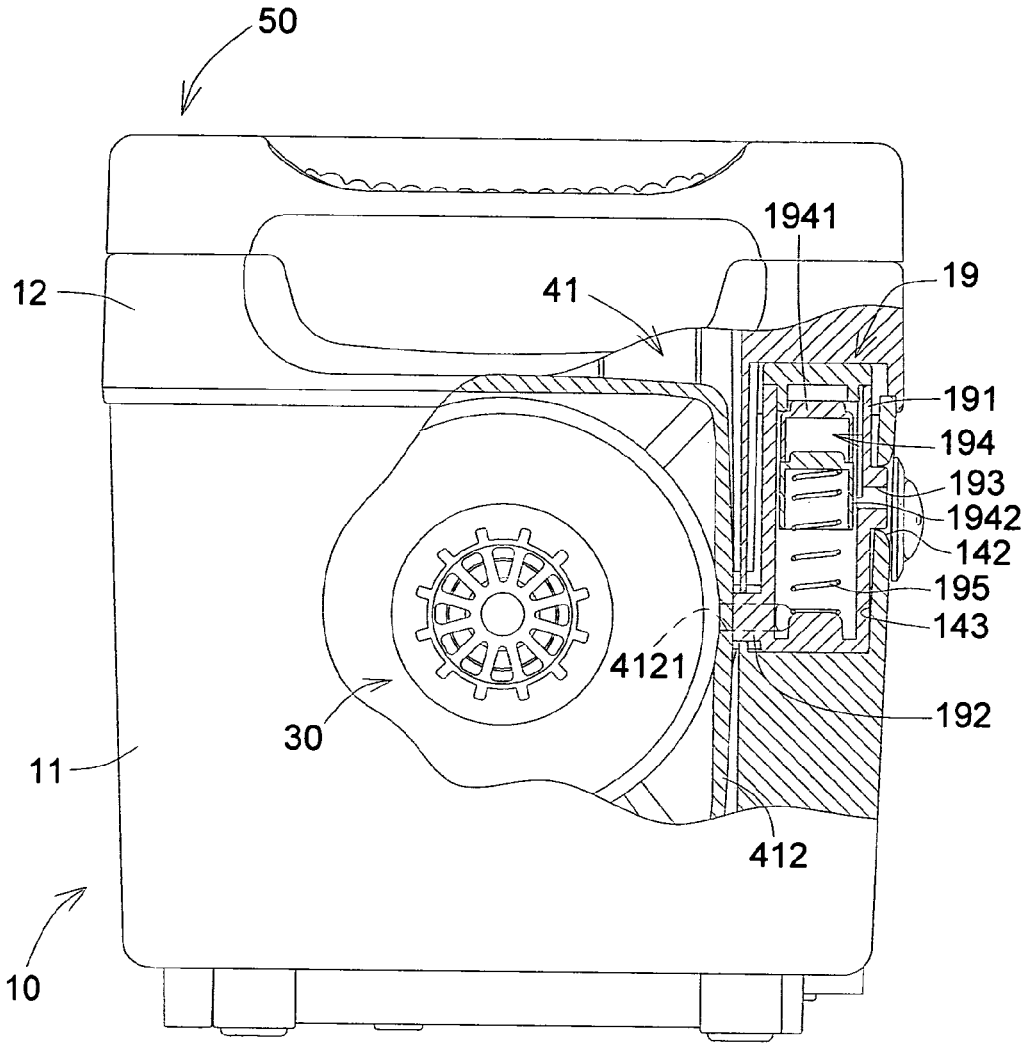
FIG. 9 is a sectional view of the filter monitor of the discussed preferred embodiment.

Now referring to FIG. 9, the connecting pipe 192 is extended into an air guide 41 and the monitor body 191 further comprises a window 193 arranged at the middle left surface thereof facing outward and an observation hole 142 is provided on the left surface of the housing 10 correspondingly to the window 193. In the monitor body 191, a columned floating block 194 as well as a spring 195 are arranged wherein the floating block 194 is composed of an upper block 1941 and a lower block 1942 which are stacked and distinctively-colored and the spring 195 is provided between the lower block 1942 and the bottom surface of the body 191 to prop up the floating block 194 in the manner that the lower block 1942 normally appears at the window 193.

Figure 8:
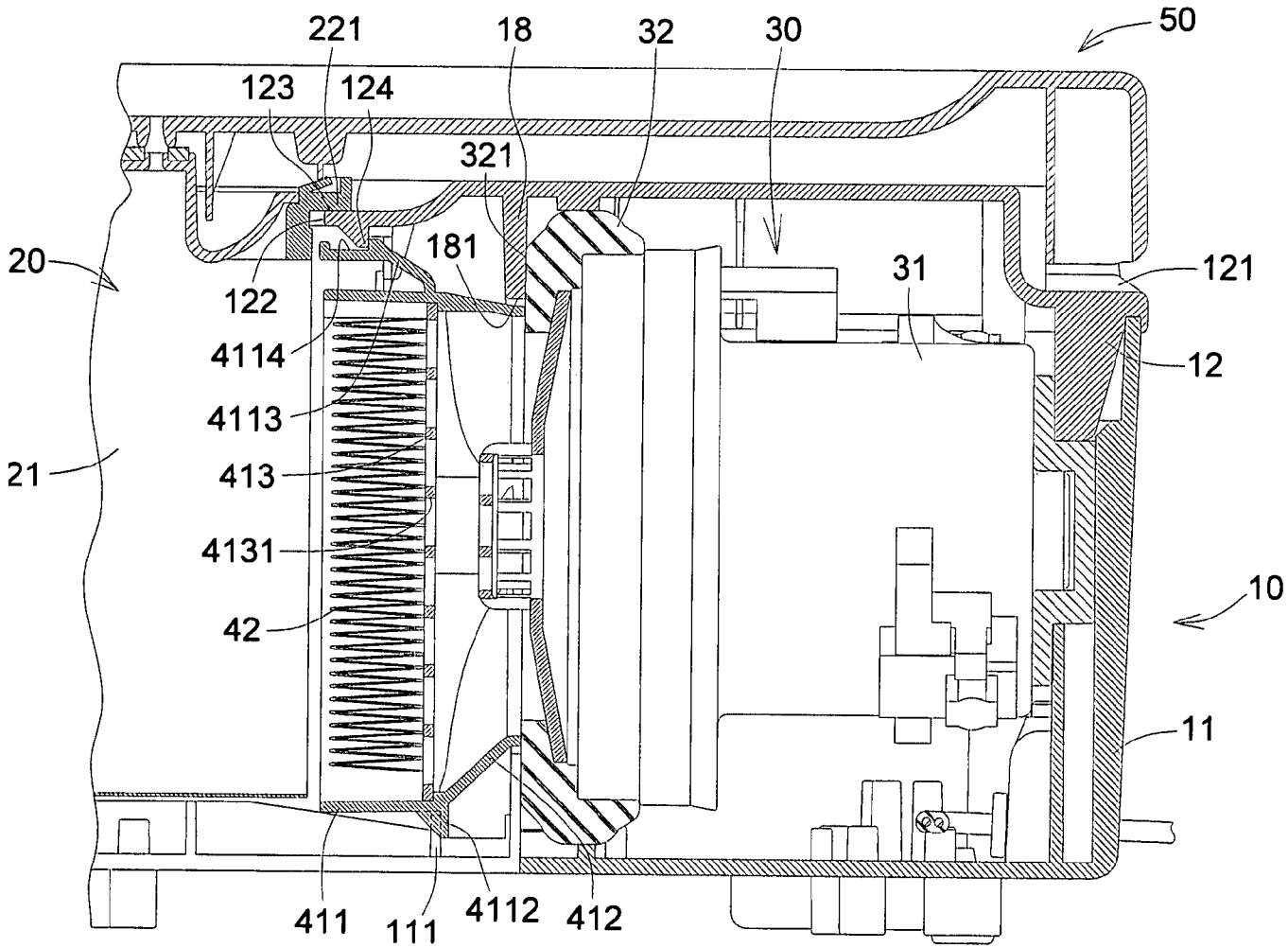
FIG. 8 is another sectional view of the discussed preferred embodiment.

As shown in FIG. 8, a positioning bar 111 is formed at the middle bottom of the lower shell 11 parallel to the short side of the housing 10 and extended upward correspondingly to the filter seat 16.

The intermediate cover 12 is substantially rectangular and has a recessed pivot-jointed segment 121 at the rear top thereof, an air inlet opening 122 at the front top positionally according to the dust-collecting bag seat 15 wherein the air inlet opening 122 is in the form of a square hole and has a sunk outer shoulder portion 123 at the top periphery thereof, a protrusion 124 provided at the middle bottom of the intermediate cover 12 and extended downward positionally according to the filter seat 16 in the manner that the protrusion 124 is settled in front of the positioning bar 111.

Figure 2:
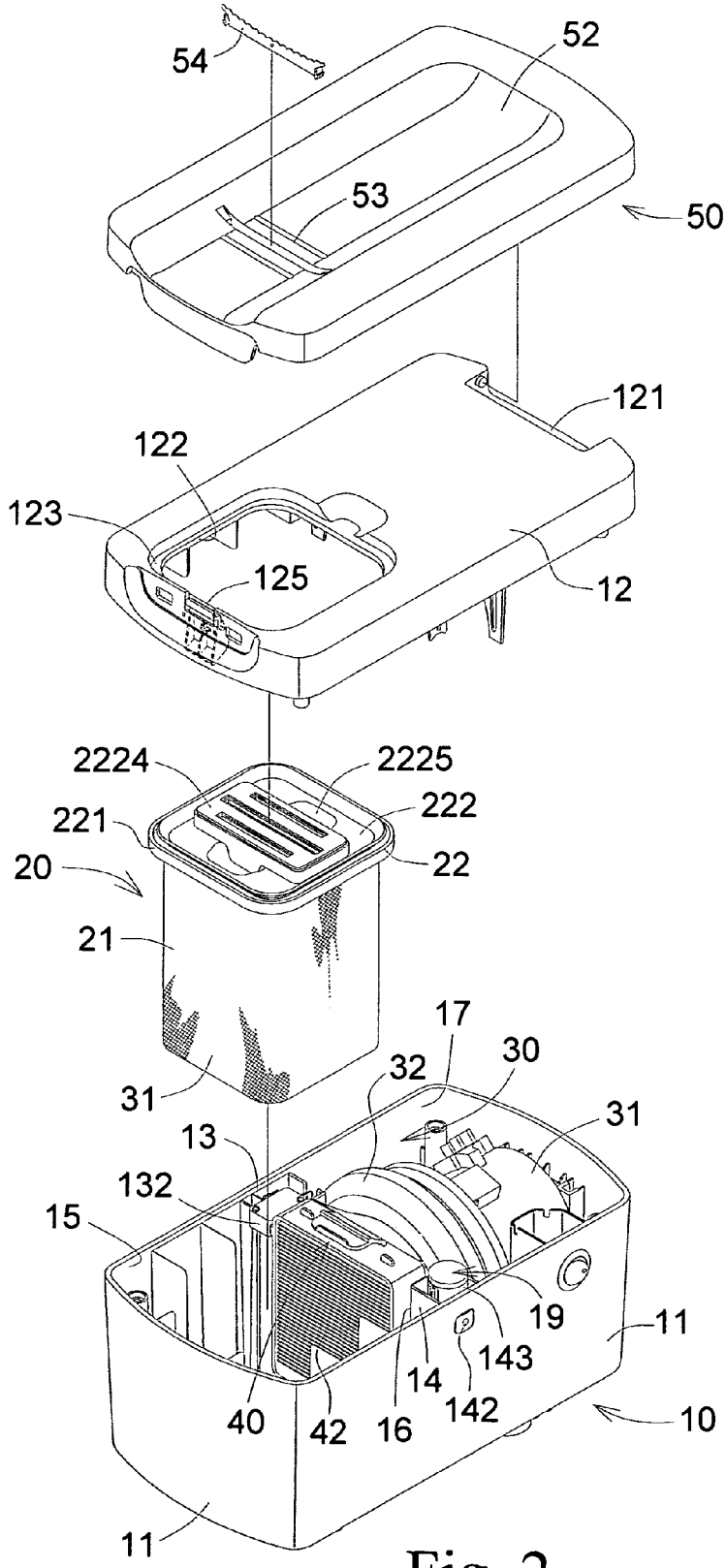
FIG. 2 is an exploded view of the discussed preferred embodiment.

According to FIG. 2, the front inner surface of the intermediate cover 12 can be combined with a mistake-proof rocker 125 which has the upper end normally jutted out from the intermediate cover 12 to be positioned at an intercalary position for impeding the combination between the upper lid 50 and the intermediate cover 12, while the lower end is extended toward the front end of the air inlet opening 122 in the manner that when the dust-collecting bag 20 is assembled into the housing 10 from the air inlet opening 122, the lower end of the mistake-proof rocker 125 can be pushed outward and in turn the upper end thereof is drawn to pivot inward the housing 10.

The dust-collecting bag 20 includes a bag 21 that is an upward-opened bag filter and accommodated in the dust-collecting bag seat 15 of the housing 10. The bag 21 further has its top periphery engaged with a lid 22 that has a fixing ring 221 and a lid plate 222 wherein the fixing ring 221 is a square section ring and has the bottom matching the top periphery of the bag 21 for being inlayed into the outer shoulder portion 123 of the air inlet opening 122 so that when the dust-collecting bag 20 is assembled to the intermediate cover 12, the front surface of the bag 21 can push the bottom of the mistake-proof rocker 125 forward and in turn cause the top of the mistake-proof rocker 125 to pivot backward.

Figure 3:
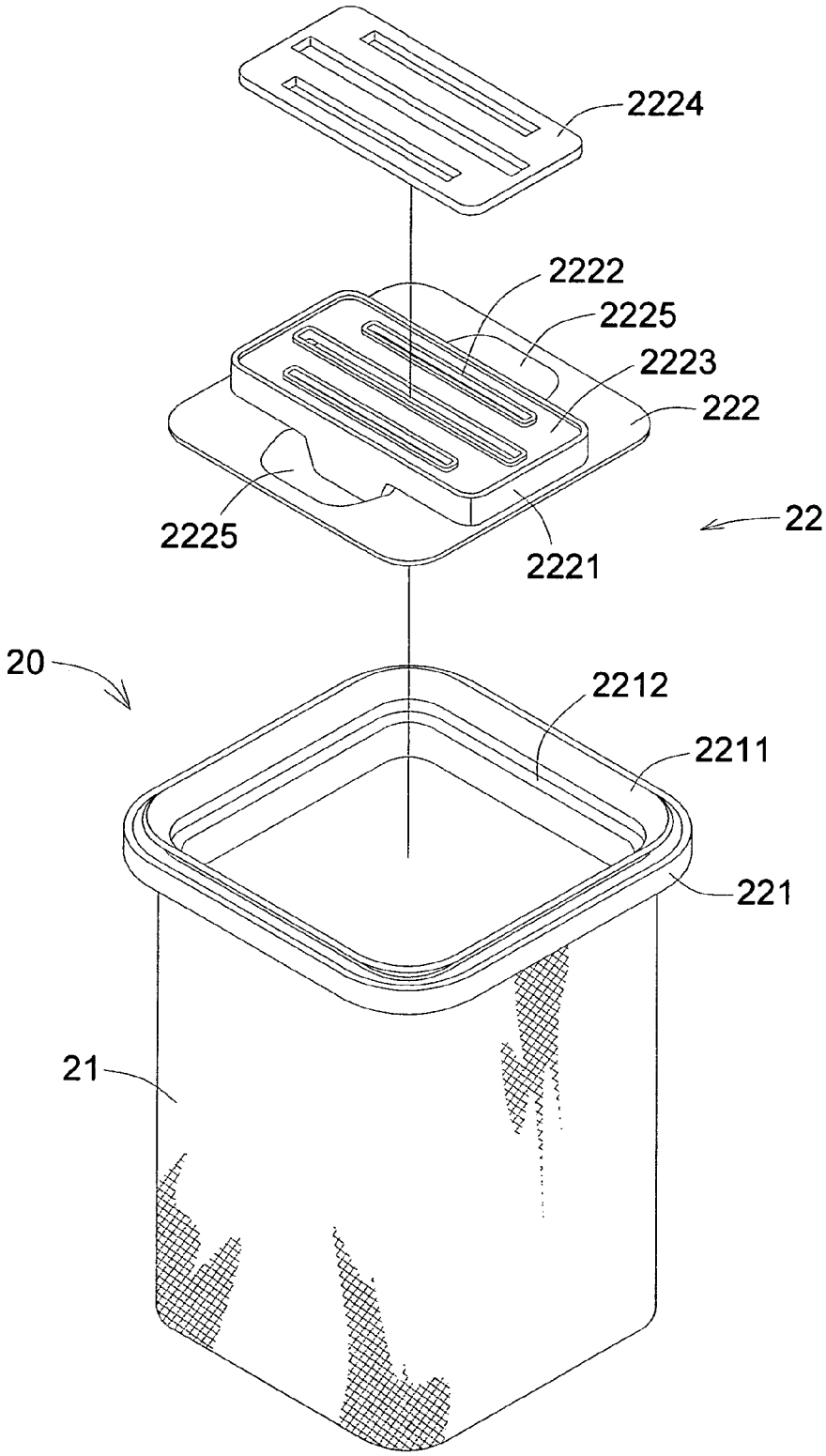
FIG. 3 is an exploded view of the dust-collecting bag according to the discussed preferred embodiment.
Figure 4:
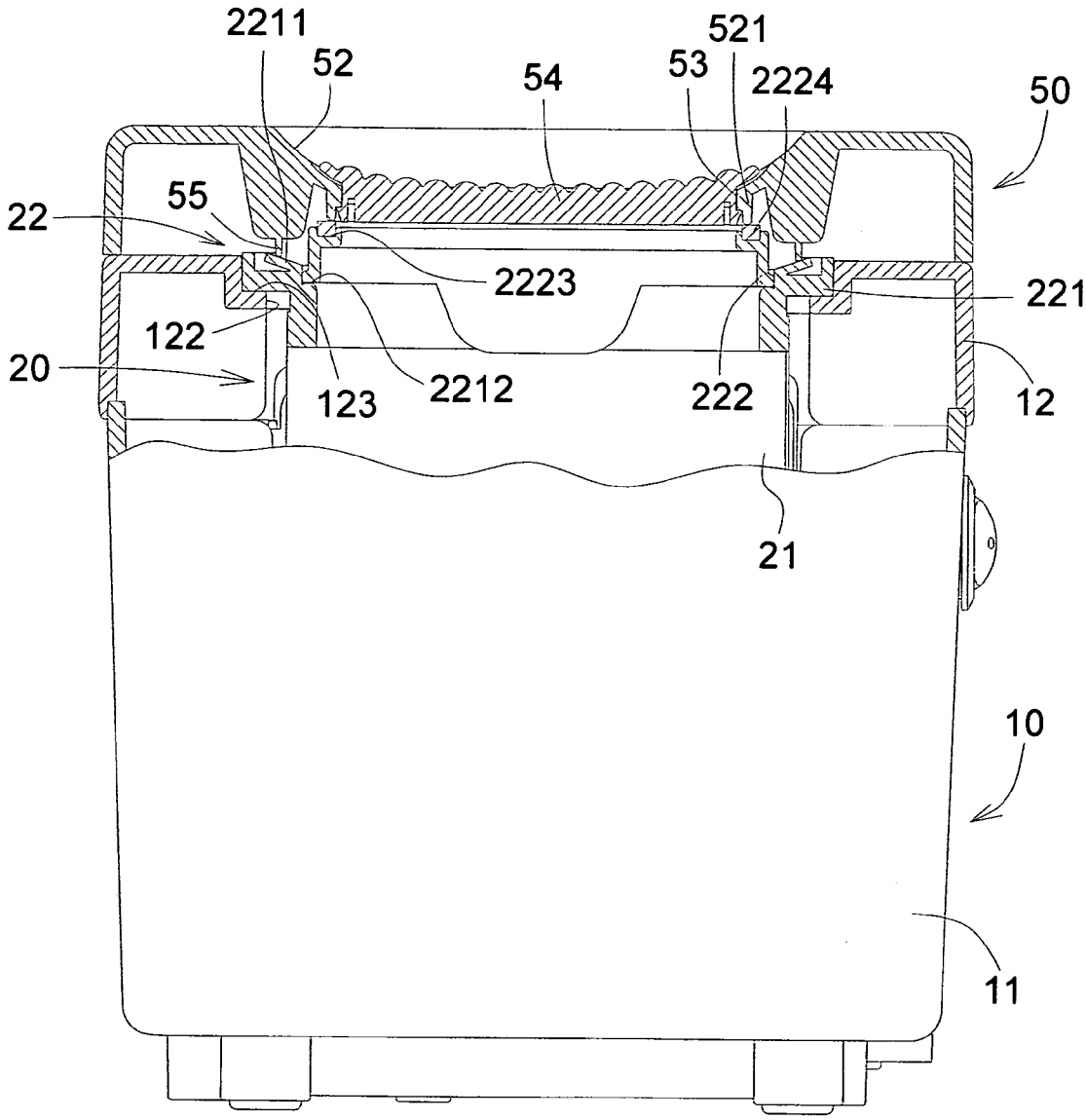
FIG. 4 is a sectional view of the discussed preferred embodiment.

As shown more clearly in FIG. 3, the fixing ring 221 comprises a flexible elastic loop 2211 at the inner side thereof extended upward and outward at an angle, and a square sunk inner shoulder portion 2212 formed around the inner top periphery thereof.

The lid plate 222 is in a square shape and the periphery thereof is received by the inner shoulder 2212. Further, the lid plate 222 contains a rectangular raised portion 2221 which is arranged in the manner that the long sides thereof are perpendicular to those of the housing 10 and has a flat top. The raised portion 2221 further contains three lengthwise lower air inlet slits 2222 each paralleling the long sides of the raised portion 2221, and a recess 2223 formed among the periphery of the raised portion 2221 and the lower air inlet slits 2222 for closely receiving a correspondingly shaped gasket 2224 in the manner that the assembled gasket 2224 has the top standing higher than the raised portion 2221. Moreover, the lid plate 222 comprises a pair of grasping recesses 2225 located at the opposite sides of the raised portion 2221 respectively whereby a user can grasp the lid plate 222 and pull it apart from the fixing ring 221.

Referring to FIG. 8, the vacuum suction device 30 is accommodated in the vacuum suction device seat 17 and comprises a suction motor 31 having an elastic annular sealing ring 32 sleeved onto the front end thereof to form an annular combining portion 321 which possesses an inner diameter slightly smaller than that of the round hole 181 of the partition 18 so that the combining portion 321 may be closely adhered to and abutting the periphery of the round hole 181.

Figure 6:
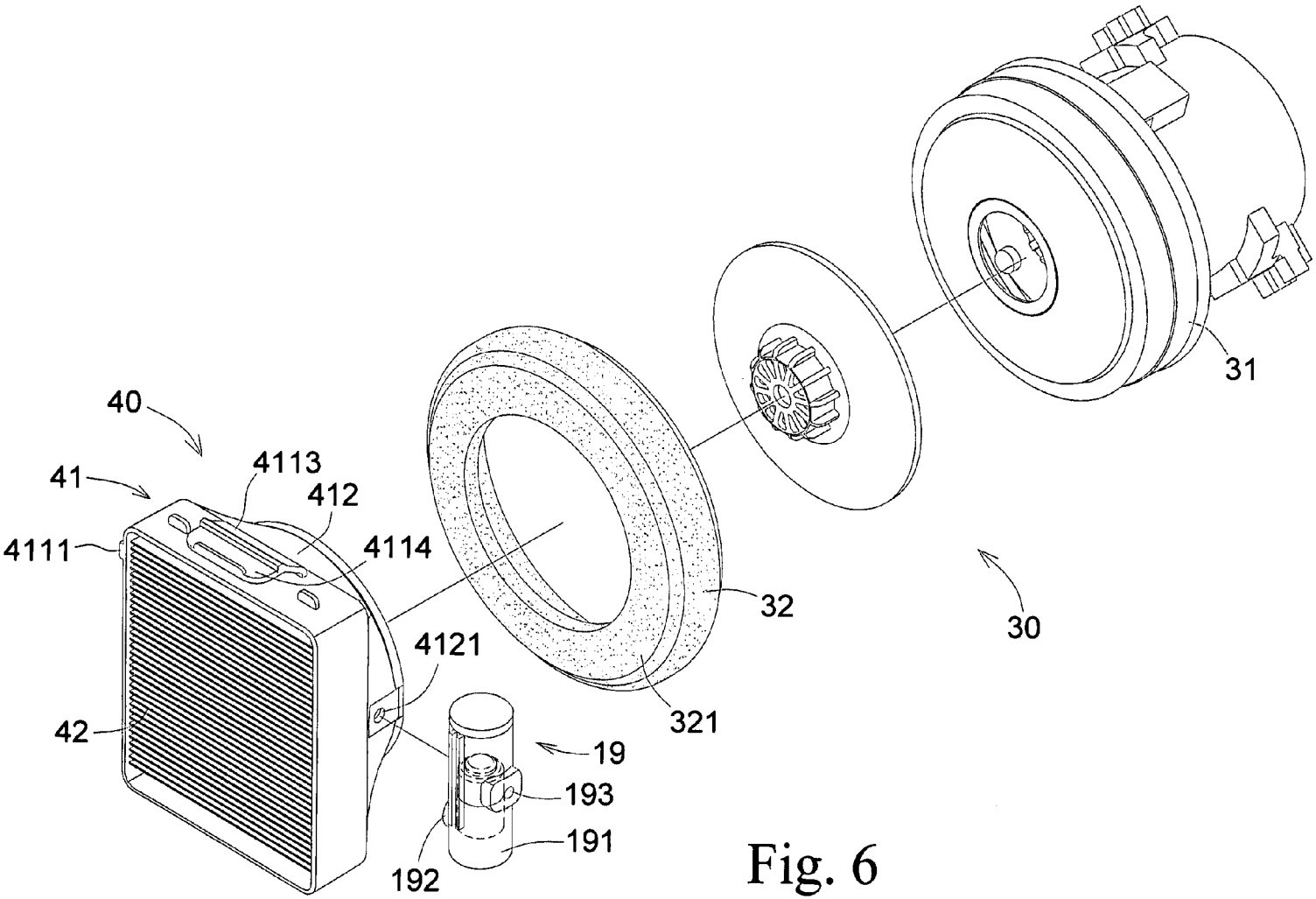
FIG. 6 is an exploded view of the vacuum suction device and the filter according to the discussed preferred embodiment.

In FIG. 6, the filter 40 is inserted into the filter seat 16 and positioned between the partition assemblies 13, 14. Such filter 40 includes the air guide 41 formed in the manner that a square filter niche 411 is established at the front; a pressing piece 4111 is settled at the right side of the square filter niche 411 positionally according to the button 133 of the micro switch 132; a filter net 42 is niched into the filter niche 411; an cone-shaped connecting portion 412 is extended backward from the filter niche 411 and has its rear end closely adhered to and abutting the inner periphery of the combining portion 321 of the sealing ring 32; and the cone-shaped connecting portion 412 has a connecting hole 4121 at its left surface for communication with the external end of the above-discussed connecting pipe 192.

As shown in FIG. 8, a partition 413 having a plurality of through holes 4131 is further provided at the rear of the filter niche 411 for being combined with the filter net 42.

The air guide 41 has its bottom contacted with the upper edge of the positioning bar 111 and comprises a wing 4112 extended downward and alongside the positioning bar 111 in the rear thereof. Besides, the air guide 41 further includes a flexure strip 4113 at its top extended slantwise upward to the protrusion 124, and a notch 4114 provided at the free end of the flexure strip 4113 for retaining the protrusion 124. By foresaid structure, the air guide 41 can be positioned and fastened at the filter seat 16.

Referring back to FIG. 1, the upper lid 50 has a rectangular shape fitting the intermediate cover 12 and possesses a front end and a rear end wherein the rear end includes a pivot member 51 for being engaged with the pivot-jointed segment 121 so as to realize a pivotable lid with respect to the top of the housing 10.

Figure 5:
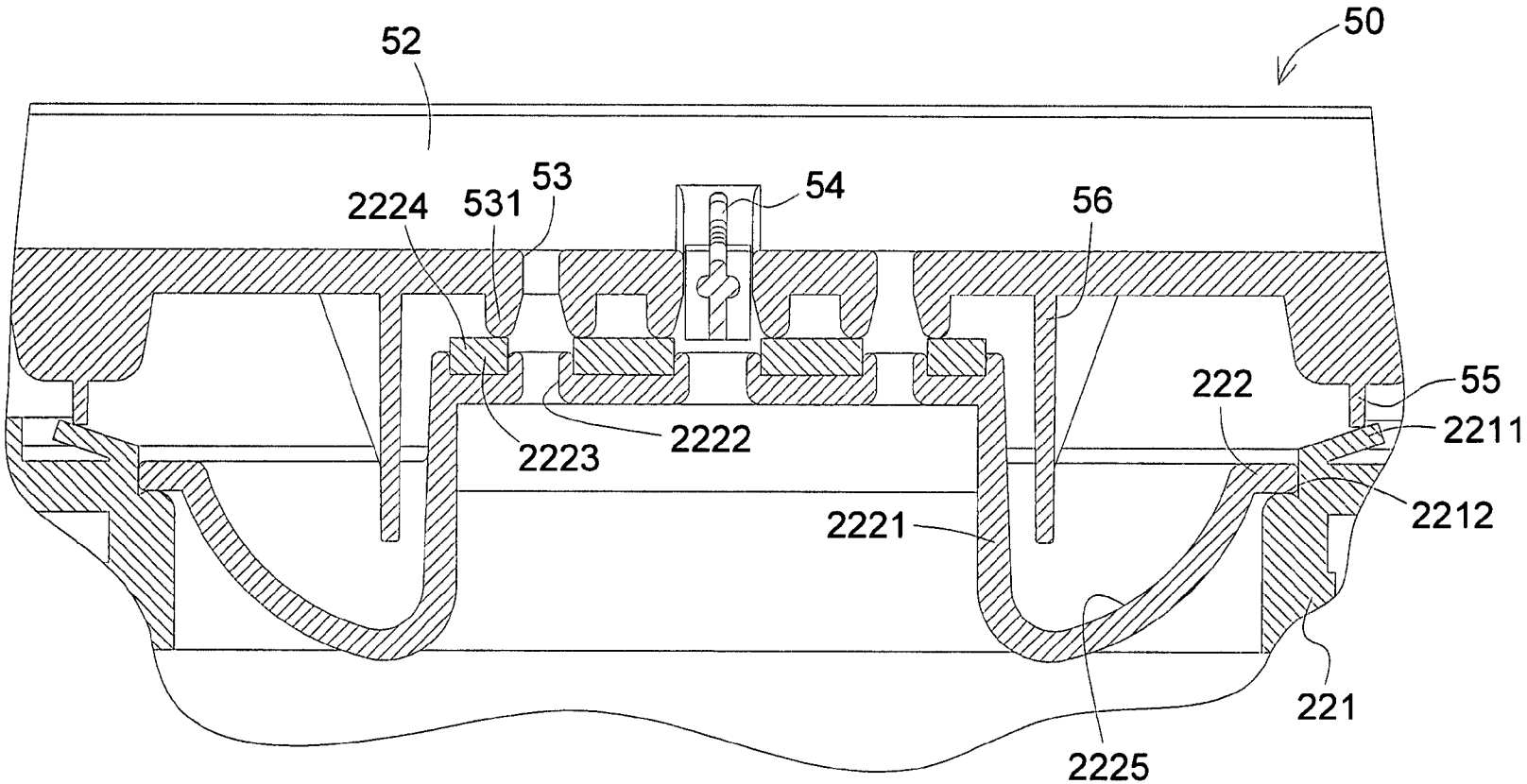
FIG. 5 is a partial schematic cross sectional view of the discussed preferred embodiment.

As illustrated in FIG. 5, a depressed portion 52 is formed at the top surface of the upper lid 50 along the long sides thereof, which has three parallel upper air inlet slits 53 positionally corresponding to said lower air inlet slits 2222 at the front section, a scraper 54 inlayed in the intermediate upper air inlet slit 53, and a sealing flange 531 extended downward from the bottom for each of the upper air inlet slits 53 for touching the gasket 2224 surrounding the lower air inlet slits 2222. Thereby, the communication of each pair of the upper air inlet slits 53 and the lower air inlet slits 2222 is established.

Further, a square-shaped pressing loop 55 is perpendicularly extended downward from the bottom of the upper lid 50 for closely pressing the flexible elastic loop 2211 of the fixing ring 221 so that the airtight combination between the upper lid 50 and the lid 22 is accomplished.

The description is now referred back to FIG. 1. It can be seen that a pair of mistake-proof members 56 is perpendicularly extended downward from the bottom of the upper lid 50 for being respectively accommodated in the grasping recesses 2225.

To operate the disclosed subject matter of the present invention, the vacuum suction device 30 is firstly started and a suction force can be therefore presented at the air inlet opening 122 of the housing 10. When using the subject matter disclosed in the preferred embodiment for cleaning a blackboard eraser, a user can rub the blackboard eraser against the scraper 54 by moving the eraser back and forth in the depressed portion 52 of the upper lid 50 to scrap the chalk dust from the eraser, and synchronously, the scrapped chalk dust is sucked into the disclosed apparatus from the upper air inlet slits 53 of the upper lid 50.

Since each pair of the upper air inlet slits 53 and lower air inlet slits 2222 are combined under the enclosure of the combination of the sealing flange 531 and the gasket 2224, the chalk dust entering from the upper air inlet slits 53 can be directly sucked into the bag 21 through the lower air inlet slits 2222 and prevented form diffusing between the dust-collecting bag 20 and upper lid 50 so that the top of the dust-collecting bag 20 can be remained clean. Furthermore, the combination of the flexible elastic loop 2211 of the fixing ring 221 and the pressing loop 55 contributes to the airtightness around the lid 22 so that chalk dust is ensured against leaking out from the lid 22.

Additionally, as the disclosed apparatus has the front end of the vacuum suction device 30 combined with the filter 40, the air flow to be sucked into the suction motor 31 can be further treated by means of the filter net 42 of the filter 40 to filtrate any chalk dust retained therein escaping from the dust-collecting bag 20 so that the suction motor 31 can be protected from the potential damage caused by the entrance of the dust. Also, the sealing ring 32 provided between the suction motor 31 and the filter 40 further precludes the possibility of loosening therebetween and therefore the improved dust-proof effect is achieved.

To clean up the dust-collecting bag 20 of the disclosed subject matter, a user can lift the upper lid 50; take out the dust-collecting bag 20 from the housing 10; hold the grasping recesses 2225 to take the lid plate 222 apart form the fixing ring 221; pour out the dust retained in the bag 21 and replace the lid plate 222. Afterward, when the dust-collecting bag 20 is put back into the housing 10 by way of the air inlet opening 122, if the dust-collecting bag 20 is misplaced, the mistake-proof members 56 can not be received by the grasping recesses 2225 and the upper lid 50 can not be combined with the intermediate cover 12 normally. Thus, it is ensured that the reassembly shall never end in misplacement of the dust-collecting bag 20 so that the upper air inlet slits 53 and lower air inlet slits 2222 can be always aligned and the weakened suction effect due to misplacement of the dust-collecting bag 20 can be prevented.

Figure 10:
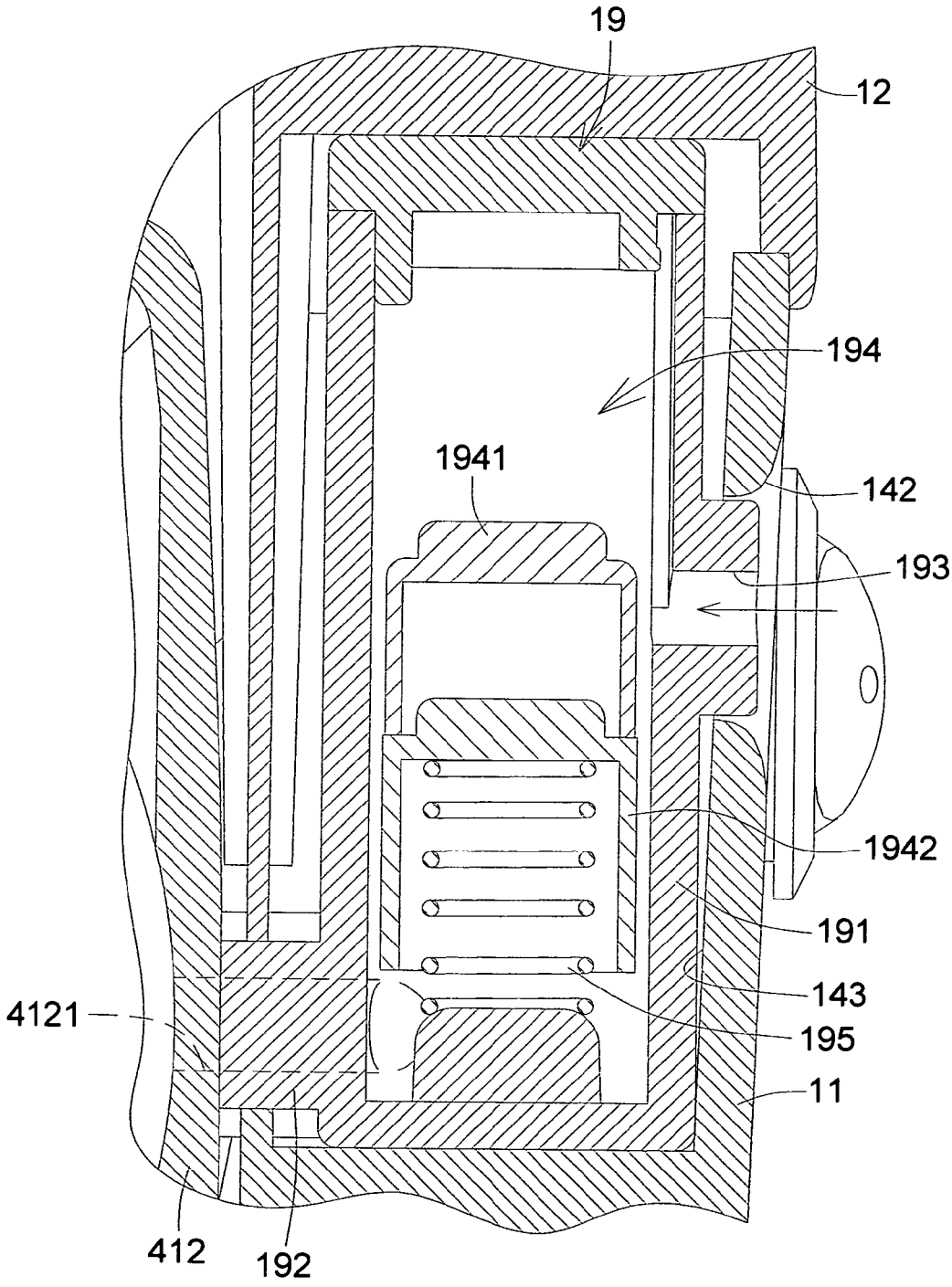
FIG. 10 is an applied view showing the motion of the filter monitor.

The filter monitor 19 arranged beside the filter 40 is provided for indicating the clogged condition of the filter net 42 of the filter or the dust-collecting bag 20 and helps a user's determination of when the filter net 42 of the filter or the dust-collecting bag 20 has to be renewed. Generally, the filtrate materials can get clogged after an interval of use and the suction force can make air sucked from the window 193 of the filter monitor 19 into the air guide 41 through the connecting pipe 192. At this point, the downward going air flow in the body 191 can push the floating block 194 down, as shown in FIG. 10 so that the user can observe the variation of the floating block 194 in the window 193 through the observation hole 142 on the housing 10. As the block 194 is drawn down and the upper block 1941 is presented at the window 193, the user can get a direction of renewing the filtrate materials and thereby the filter monitor 19 accomplishes a function of warning.

To change the filter 40, the user may lift the upper lid 50; take out the dust-collecting bag 20; put a hand into the air inlet opening 122 to press the flexure strip 4113 to release the protrusion 124 at the bottom of the intermediate cover 12 from the notch 4114 of the filter 40; and draw out the filter 40 from the air inlet opening 122. To reinstall a new filter 40, inlay it slantwise into the filter seat 16; engage the wing 4112 thereof with the positioning bar 111 settled on the bottom shell 11; push the top thereof into the filter seat 16; and make the notch 4114 of the flexure strip 4113 engaged with the protrusion 124 at the bottom of the intermediate cover 12 so that the rear end of the air guide 41 can closely adhere to and abut the combining portion 321 of the sealing ring 32 and therefore the reinstallation of the filter 40 is realized.

Figure 11:
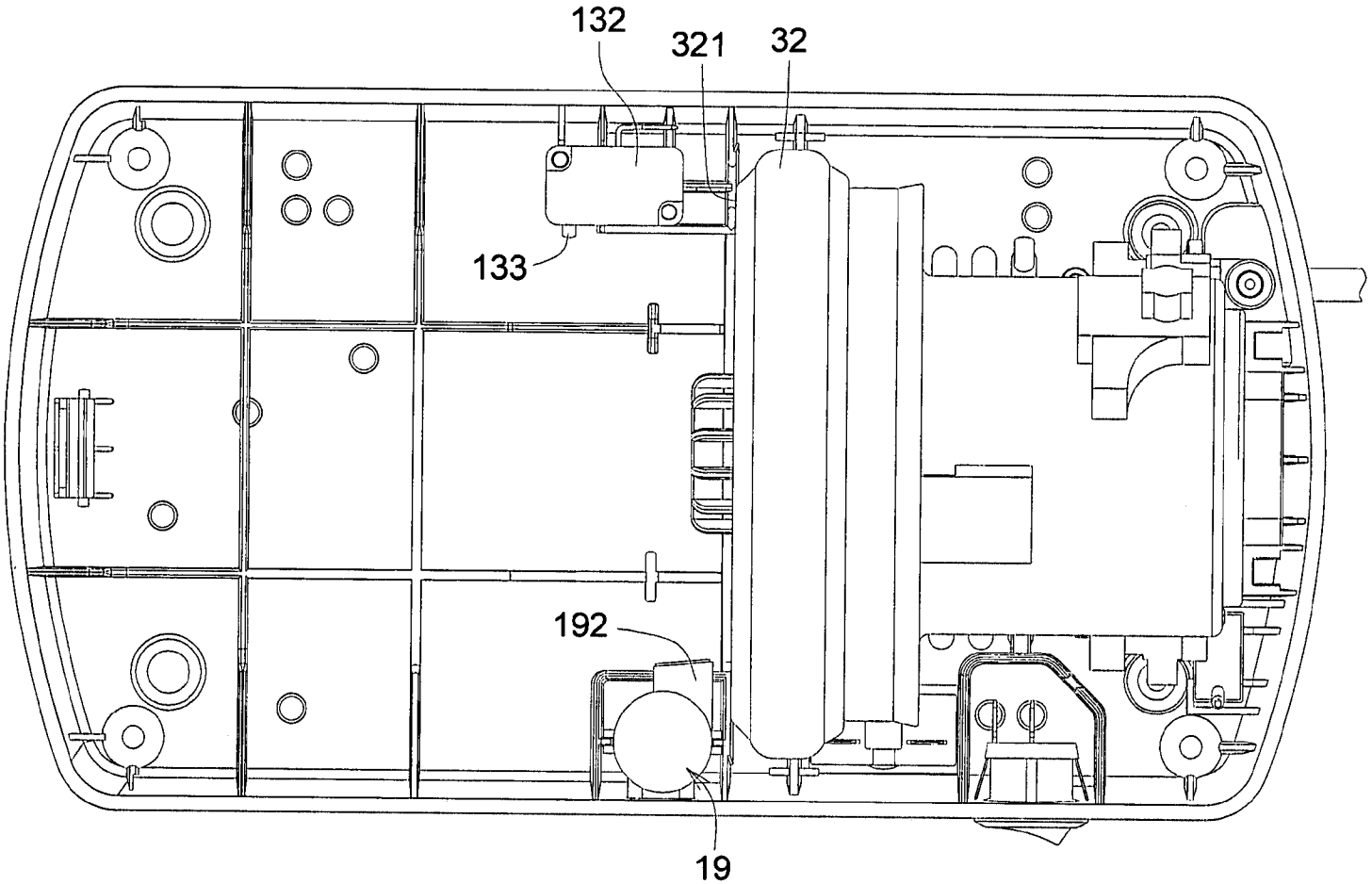
FIG. 11 is another top view showing the discussed preferred embodiment without the presence of the intermediate cover, dust-collecting bag and filter.
Figure 12:
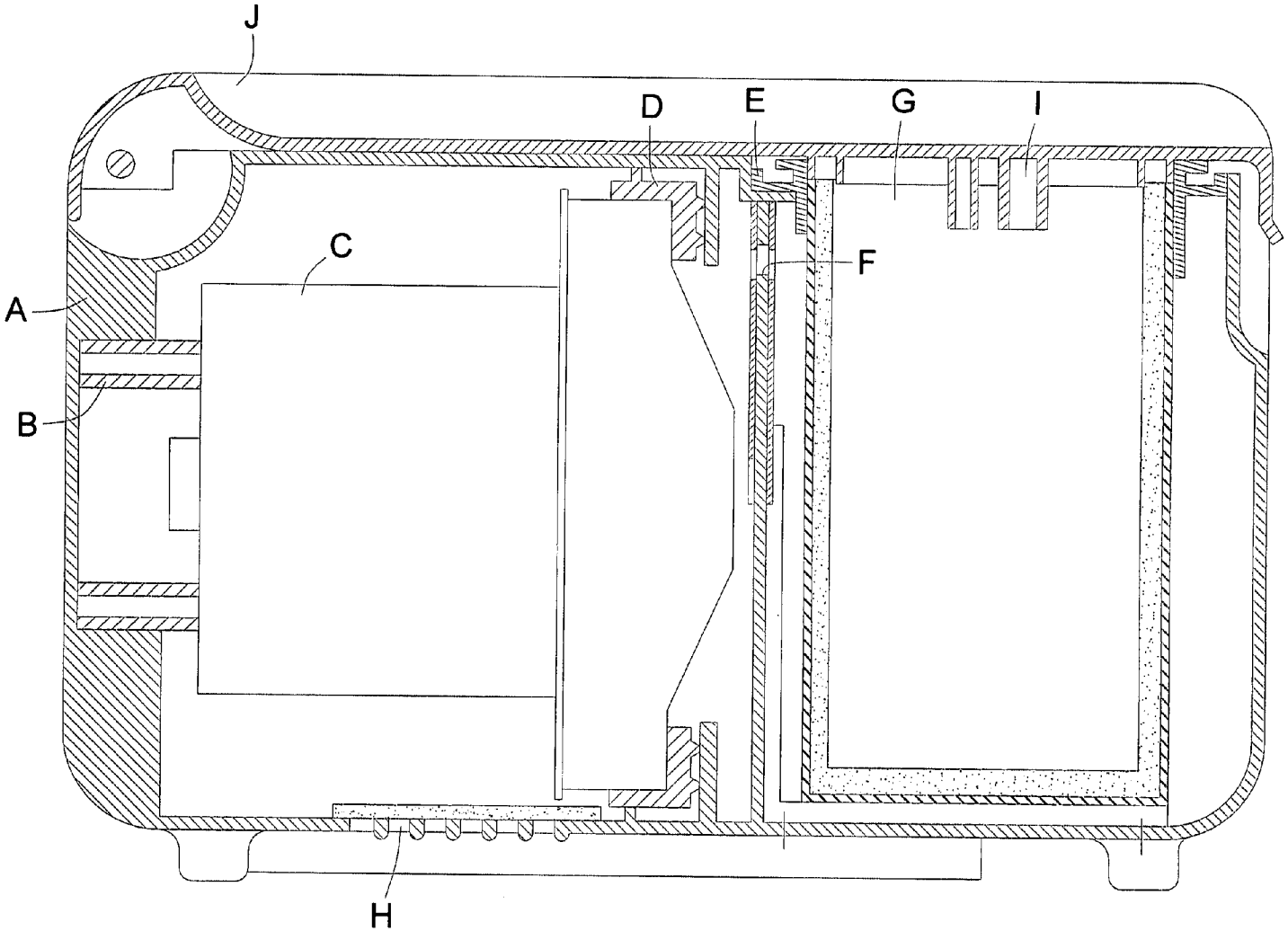
FIG. 12 is a sectional view of a prior-art chalk-dust collecting apparatus for blackboard erasers.

In case the filter 40 is not correctly installed in the filter seat 16, the suction motor 31 can not be started because the button 133 of the micro switch 132 is not pressed by the pressing piece 4111 of the filter 40, as shown in FIG. 11. Thus, the suction motor 31 is secured from operation without the protecting of the filter 40 and therefore the preferred dust-proof effect of the suction motor 31 can be reached.

What is claimed is:

1. A chalk-dust collecting apparatus, which comprises:

a housing, which includes an air inlet opening at the top thereof;

a vacuum suction device installed in the housing, and an upper lid pivotally combined with the housing for covering the top of the housing having a plurality of upper air inlet slits positioned accordingly to the air inlet opening; wherein a dust-collecting bag settled in the housing, wherein the air inlet opening is attached by a dust-collecting bag which comprises a lid positioned at the top thereof for being combined with the air inlet opening in a sealed manner, wherein the lid further comprises a plurality of lower air inlet slits in the manner that each said lower air inlet slit is correspondingly positioned with respect to and airtightly intercommunicated with a respective of said upper air inlet slits.

2. The chalk-dust collecting apparatus as claimed in claim 1, wherein a sealing flange is extended downward from the bottom periphery of each said upper air inlet slit for tightly pressing the periphery of a respective said lower air inlet slit.

3. The chalk-dust collecting apparatus as claimed in claim 1, wherein the dust-collecting bag comprises a bag, which is accommodated in the housing.

4. The chalk-dust collecting apparatus as claimed in claim 3, wherein a sunk outer shoulder portion is formed along the top periphery of the air inlet opening for receiving an annular fixing ring provided at the top periphery of the bag.

5. The chalk-dust collecting apparatus as claimed in claim 4, wherein a sunk inner shoulder portion is formed along the top inner periphery of the fixing ring for receiving the periphery of a lid plate included by the lid, whereby the lid, the dust-collecting bag and the housing can be airtightly combined.

6. The chalk-dust collecting apparatus as claimed in claim 5, wherein a top-raised prominent portion is formed at the middle of the lid plate and equipped with said lower air inlet slits.

7. The chalk-dust collecting apparatus as claimed in claim 5, wherein two grasping recesses are formed on the lid plate oppositely aside the group of the lower air inlet slits.

8. The chalk-dust collecting apparatus as claimed in claim 7, wherein a pair of mistake-proof members is vertically extended downward from the bottom of the upper lid in the manner that each said mistake-proof member is accommodated in a respective said grasping recess when the upper lid is affixed to cover the top of the housing.

9. The chalk-dust collecting apparatus as claimed in claim 4, wherein an elastic loop is formed at the top periphery of the fixing ring corresponding to a pressing loop vertically extended downward from the bottom of the upper lid in the manner that the bottom edge of the pressing loop can tightly press against the elastic loop.

10. The chalk-dust collecting apparatus as claimed in claim 1, wherein an intermediate cover having the air inlet opening at the front end thereof is assembled over the housing.

11. The chalk-dust collecting apparatus as claimed in claim 10, wherein a mistake-proof rocker is pivotably arranged at the front inner surface of the intermediate cover in the manner that an upper end thereof is normally jutted out intermediately between the housing and the upper lid while a lower end thereof is extended toward the front end of the air inlet opening and when the dust-collecting bag is assembled in to the housing from the air inlet opening, the lower end of the mistake-proof rocker is pushed outward and in turn the upper end thereof is drawn to pivot inward the housing.

12. The chalk-dust collecting apparatus as claimed in claim 1, wherein at least one said upper air inlet slits is equipped with a scrapper.

13. The chalk-dust collecting apparatus as claimed in claim 1, wherein a filter is provided in the housing intermediately between the dust-collecting bag and the vacuum suction device.

14. The chalk-dust collecting apparatus as claimed in claim 13, wherein the filter comprises an annular-shaped air guide and a filter net fastened fixedly in the air guide.

15. The chalk-dust collecting apparatus as claimed in claim 14, wherein a sealing ring is provided between the air guide and the vacuum suction device for ensure airtight combination between the filter and the vacuum suction device.

16. The chalk-dust collecting apparatus as claimed in claim 14, wherein a filter niche is formed at the front end of the air guide for receiving a partition with a plurality of through holes so that the filter net can be fastened to the partition and inlaid in the filter niche and is followed by a cone-shaped connecting portion for combining with said sealing ring.

17. The chalk-dust collecting apparatus as claimed in claim 14, wherein a micro switch is arranged in the housing correspondingly to the air guide in the manner that the micro switch can be normally switched on under correct assembly of the air guide.

18. The chalk-dust collecting apparatus as claimed in claim 14, wherein a connecting hole is provided on the side surface of the air guide and positioned behind the filter net for communicating with a filter monitor, which is fixed in the housing wherein an observation hole is provided on the side of the housing corresponding to the filter monitor.

19. The chalk-dust collecting apparatus as claimed in claim 18, wherein the filter monitor includes a body which is substantially in a vertical column shape and intercommunicated with the connecting hole, a window arranged correspondingly to observation hole at the middle surface of the body, a floating block accommodated in the body, and a spring provided between the floating block and the bottom surface of the body.

20. The chalk-dust collecting apparatus as claimed in claim 19, wherein the floating block is composed of an upper block and a lower block, which are distinctively-colored and the lower block is normally positioned correspondingly to the window.

* * * * *